US005747980A

United States Patent [19]

Gershen

[11] Patent Number: 5,747,980

[45] Date of Patent: May 5, 1998

[54] DIFFERENTIAL TRANSFORMER CORRECTION BY COMPENSATION

[75] Inventor: Bernard Gershen, Centerport, N.Y.

[73] Assignee: Leviton Manufacturing Co., Inc., Little Neck, N.Y.

[21] Appl. No.: 453,608

[22] Filed: May 30, 1995

[51] Int. Cl.[6] ..... H01F 15/04

[52] U.S. Cl. ..... 323/356

[58] Field of Search ..... 323/355, 356; 336/846

[56] References Cited

U.S. PATENT DOCUMENTS

| | | | |
|---|---|---|---|
| 3,041,528 | 6/1962 | Alizon et al. | 323/89 |
| 3,122,700 | 2/1964 | Gabriel et al. | 323/89 |
| 3,532,964 | 10/1970 | Marks | 323/60 |
| 3,633,070 | 1/1972 | Vassos | 317/18 D |
| 3,881,149 | 4/1975 | Kiko | 323/6 |
| 4,027,235 | 5/1977 | Macrander et al. | 323/48 |
| 4,064,449 | 12/1977 | Macrander | 323/48 |
| 4,412,193 | 10/1983 | Bienwald et al. | 335/18 |
| 4,607,142 | 8/1986 | Martin | 179/16 AA |
| 4,607,211 | 8/1986 | Eissman | 323/56 |
| 5,150,046 | 9/1992 | Lim | 323/356 |

*Primary Examiner*—Aditya Krishnan
*Attorney, Agent, or Firm*—Paul J. Sutton

[57] ABSTRACT

A differential transformer includes a magnetic core within which difference signal detection inaccuracies resulting from non-homogeneity within the core are corrected by compensation. A phase wire extends proximate the magnetic core for transporting a first current in a first direction. A neutral wire extends proximate the magnetic core center for transporting a second current in a second direction which is substantially opposite the first direction. A shunt wire is electrically connected to one of: the phase wire and the neutral wire depending on whether the transformer is undersensitive or oversensitive. The shunt wire shunts a portion of the current flowing in one of the phase and neutral wires such that first and second signals are generated in the transformer as a result of said first and second currents that are substantially equal.

10 Claims, 2 Drawing Sheets

DIFFERENTIAL TRANSFORMER CORRECTION BY COMPENSATION

BACKGROUND OF THE INVENTION

FIELD OF THE INVENTION

The present invention relates to differential transformers and, more particularly, to compensating for the effects of non-homogeneities within magnetic cores of differential transformers.

Differential transformers are used in electrical circuits to detect signal level differentials therein and generate a differential voltage signal in proportion thereto. For example, a differential transformer may utilize a magnetic core through which at least two conductors are threaded to determine a difference in the currents flowing within each conductor. Each current generates a field in the core which in turn generates a current or voltage signal corresponding to the detected current flow difference. For example, there may be equal currents flowing in opposite directions such that the field generated by each current will theoretically cancel the others' corresponding generated field. If the two oppositely flowing currents are not equal in magnitude, the current-generated fields do not completely cancel each other resulting in a net field. The net field generates a signal in a tap or transformer secondary which is in proportion to the current signal level difference.

In one application, differential transformers may be utilized to detect a difference in currents flowing to and from a load in phase and neutral wires, respectively, electrically connecting the load to an AC source. The phase and neutral wires are arranged relative a magnetic core of the transformer such that each current generates a magnetic flux in proportion to the core permeability, core homogeneity, distance from the conductor to the core, etc. If the current flowing through the neutral wire is substantially equal to that current flowing in the phase wire, the flux density generated by the neutral-wire current cancels the field caused by the phase-wire current. If a short or ground fault occurs on the load side of the differential transformer, there will be less current retuning in the neutral wire and therefore a net flux density results. A sense winding wrapped around the core senses the net flux density, generating a voltage signal in proportion thereto (i.e., the current difference signal). The accuracy of the detected difference, however, is dependent upon the integrity of the core, i.e., its homogeneity. This is because magnetic cores manufactured with non-homogeneous material tend to be sensitive to fields (magnetic flux) generated by currents flowing in other portions of the circuit. In consequence, the current difference signal generated can be inaccurate.

Ground fault circuit interrupters (GFCIs) typically include a differential transformer with a toroidal magnetic core to detect differences in currents flowing in both directions between a source and a load. Based on a quantitative difference in an amount of current flowing to and returning from the load through the core, the GFCI will identify a ground fault in the circuitry on the load side of the GFCI. To accomplish its task, the toroidal core is arranged to circumscribe a pair of wires connecting a phase and neutral port of the AC source to phase and neutral ports of the load. Upon detecting that there is more current flowing into (or out of) the load through the feed (phase) wire than flowing from the load to the source via the return (neutral) wire, the differential transformer generates a signal in proportion to the difference. The signal (current difference signal) is compared against a standard of allowable leakage current which may or may not define a condition in which the GFCI is called upon to interrupt the flow of AC to the load. A means for interrupting the flow of current to the load is actuated to stop the current flow in response thereto.

Because the current difference signal represents a detected difference in, for example, the magnitude of two currents flowing in two separate paths through the differential transformer, a detected change in the current difference signal indicates a change in the magnitude of one of the currents. For example, a ground fault leakage current in a load supplied by one of the two current paths passing through the core for current difference monitoring would result in a drop in an amount of current returning to the source from the load. This results in a current difference detection (i.e., a change in the magnitude of the current difference signal) while the differential transformer is operating properly.

Alternatively, imperfections in the core of the differential transformer at times introduce error into the detection of the magnitude of the current difference signal. More particularly, while the core generates signals in response to the flow of current through each of the two current paths, which should theoretically cancel when the currents are equal, imperfections in the core may lead to an erroneous generation of the current difference signal. For example, a neutral (return) current could appear larger than an equal phase (line) current flowing in opposite directions through the core (as represented by the current difference signal) due to a magnetic core imperfection. In a second case, the phase current could appear larger than the equal neutral current due another core imperfection. Therefore a GFCI set to trip based on a current difference detected (as represented by the current difference signal) at between 4 and 6 ma. could trip while a ground fault leakage current, while existing at all, is acceptably below that range. It can be seen, therefore, that toroidal core non-homogeneities compromise the device's ability to accurately detect current differences and respond accordingly in the monitored circuit. A detailed description of problems associated with toroidal core non-homogeneity is described in commonly owned U.S. patent application Ser. No. 08/212,675, filed Mar. 11, 1994, and incorporated herein by reference.

While the erroneous current-difference detection problems described above (due to a variation in permeability of the ferrite core around its circumference) can be remedied using high quality ferrites to form the toroid, or ground shields to isolate critical circuit points within the differential transformer, such remedies increase GFCI cost, which may affect product marketability. It is thus clear that what is needed is a cheap, reliable and accurate way of assuring the reliability of ferrite cores manufactured with non-homogeneous material, thereby assuring reliability of GFCIs in which they are used. In particular, it would be desirable to find a way in which finished GFCIs, including differential transformers manufactured with ferrite cores, may be effectively utilized without a need for post-manufacture toroidal core calibration or excessive rejection of finished GFCIs after testing.

OBJECTS AND SUMMARY OF THE INVENTION

It is therefore an object of the present invention to provide a differential transformer which includes a core formed of magnetic material displaying inconsistent permeability with means for adjusting the transformer's sensitivity variations in detecting signal difference as a result of the permeability variation of the core.

It is another object of this invention to provide a method for adjusting a differential signal detection sensitivity of a differential transformer formed with a toroidal magnetic core which displays irregular permeability consistency.

It is another object of the invention to provide a ground fault circuit interrupter with a trip-current calibrated differential transformer for accurately detecting ground faults whether the core from which the differential transformer is comprised displays inconsistent magnetic permeability or not.

It is yet another object of the invention to provide a method for accurately calibrating a fault-current detection sensitivity within a differential transformer of a fully-manufactured ground circuit fault interrupt device regardless of non-homogeneities present within the magnetic material forming the toroidal core.

The present invention provides a differential transformer formed with a magnetic core, the current-difference detection ability of which is impervious to insensitivities normally associated with varying core permeability. Accordingly, the need for factory personnel to rotate finished differential transformers to null out the effects of such core permeability variations is avoided. The cost of differential transformers manufactured according to the present invention is lower than that of differential transformers which accommodate non-uniform permeability's using shielding or implementing an extra step of detecting and rotating the core. Consequently, GFCIs manufactured with such improved-insensitivity cores may be calibrated quickly and accurately after manufacturing, keeping both costs and the number of rejections to a minimum.

DETAILED DESCRIPTION OF THE PREFERRED EMBODIMENT

Figure 1:
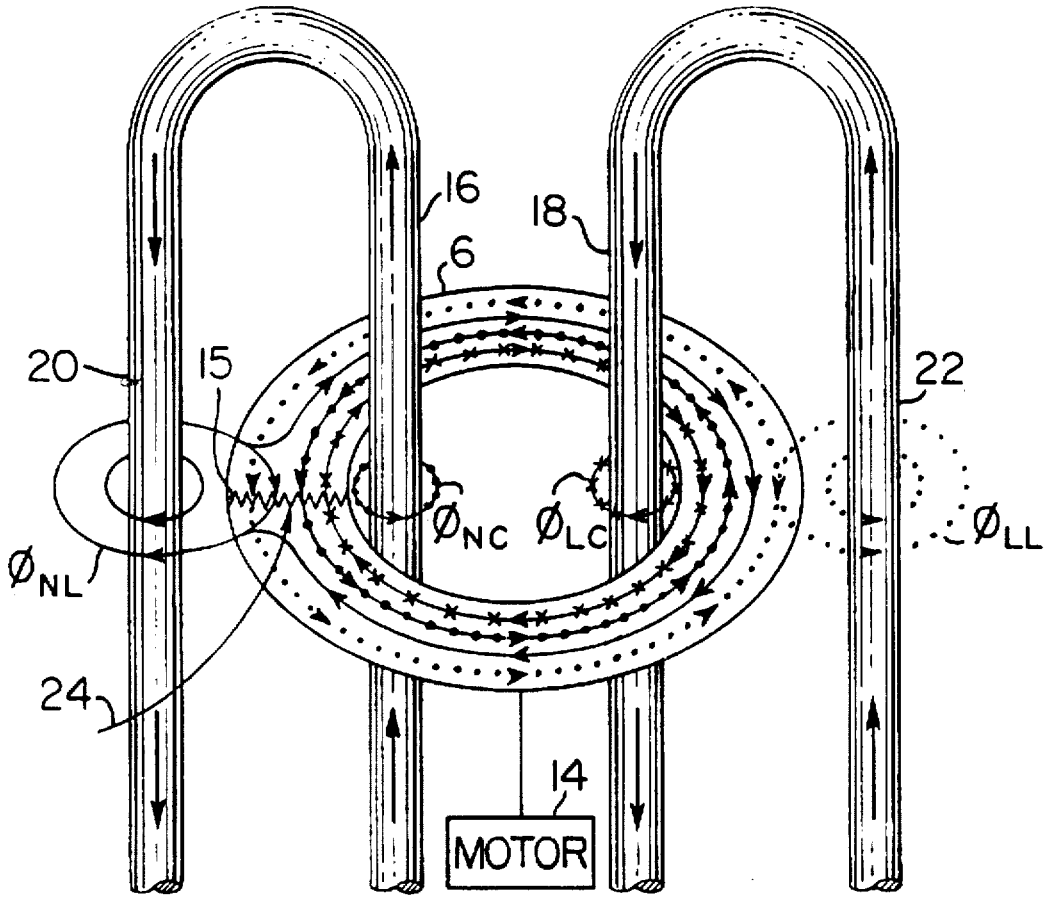
FIG. 1 is a schematic diagram of a differential transformer of the prior art, and more particularly, from commonly owned U.S. patent application Ser. No. 08/212,675, filed Mar. 11, 1994.

The present invention attempts to remedy differential signal detection sensitivity problems associated with differential transformers formed with non-homogeneous core material. For example, non-homogeneous core material may result in an inconsistent permeability at various points along a circumference of a toroidal core formed with the material. The circumferential permeability variations at times result in changes in the transformer's ability to accurately sense signal level differences within conductors passing through the transformer for monitoring, i.e., sensitivity. Accordingly, the differential transformer may inaccurately detect signal differentials identifying critical operating conditions.

While the present invention is directed to improving differential signal detection ability within differential transformers generally, the explanation and description presented herein will be specifically directed to a differential transformer used in conjunction with a ground fault circuit interrupt (GFCI) device. More specifically, the present invention will be described with regard to the improvement in the operation of GFCI devices implemented for correcting abnormal detection operating conditions which can occur with ferrite core transformers displaying magnetic core abnormalities. However, it should be noted that this description is for explanation purposes only, and is not meant to limit the scope of the invention.

As mentioned above, where a current difference signal erroneously indicates a change in leakage current as a result of magnetic core imperfections, a leakage current may be within an acceptable range when the load circuit is separated from the source by a very high impedance (e.g., a relay switch) but appear to exceed the range under load. Alternatively, a current difference signal level could erroneously indicate an acceptable detected current flow difference when the difference exceeds the specification in reality.

In consequence of a false or erroneous current difference detection, a relay or set of relay contacts in a GFCI circuit may be tripped. The current difference signal is generated in the differential transformer's toroidal core and monitored by the GFCI, as mentioned above. Although the true current difference is substantially zero, the core imperfection causes a false detection of a current difference in either side of the circuit relative the core. By introducing a compensation current equivalent in magnitude but opposite in phase to a hypothetical current difference which can be calculated from the current difference signal, the core imperfection can be simply accommodated. The circuit flow direction of the of the compensation current adjusts for phase or neutral detection under or over sensitivities. The apparent steady state current difference, as erroneously indicated by the current difference signal, is substantially nulled remedying inaccuracies resulting therefrom. GFCIs, like those manufactured by the owners of the present invention, are commonly set to "open" at the detection of a trip current between 4 and 6 milliamperes when operating with load currents of about 20 amps.

Erroneous trip currents are generated as a result of a lack of symmetry between line and neutral load wires, non-uniformly wound differential transformers, transformer-core non-uniformity resulting in non-uniform permeability, etc., generating an erroneous trip current. Several non-uniformities which can cause erroneous trip currents may be referred to herein interchangeably as magnetic anomalies (e.g., anisotropic material), remnant flux (square loop material), localized core structural damage, material impurities, magnetostriction, improper annealing procedures, etc. The magnetic anomalies or non-uniformities in particular can result in the generation of spurious voltage signals on a uniformly wound toroid (differential transformer) even when currents flowing to and from the load through the core are substantially equal. The spurious voltage signal may be sufficient to cause the trip current to be erroneously interpretted at a level which "opens" the circuit. This phenomenon will now be described with reference to a toroidal core 6 (of a differential transformer which is not wholly shown in the figure) depicted in FIG. 1.

A pair of wires 16, 18 shown in FIG. 1 are electrically connected between an AC source (not shown) and ground fault interrupt circuitry to a motor 14 (i.e., a load). The wires 16, 18 are circumscribed by a toroidal core 6. For explanation purposes, current will be presumed to flow towards the ground fault circuit interrupter from the AC source along wire portion 22 and through the toroid core 6 along wire 18 to the load 14. The neutral current returns from the load along wire 16, through the toroid core, and back to the source via wire 20. Ideally, the flux (flux densities) $Ø_{NC}$ and $Ø_{LC}$ induced in the core by current flowing through wires 16, 18, respectively, will substantially cancel each other in a case where there is no fault on the motor side of the core, i.e., the current flowing to the load substantially equals the current flowing back from the load. However, where there is a "detected" current imbalance, such as in a case where a non-uniformity in the permeability (an increase or decrease in permeability) of the core material, e.g., core portion 24 in the figure, results in inaccurate signal generation in the core portions. More particularly, "fringe" flux produced thereby results in a lower level voltage induced in turns of the coil wound at that area of the core, as compared to voltage induced at undamaged core areas not impeded within the fringe flux. This "fringe" flux, however, could alternatively result in a higher level voltage induced in the turns of the coil wound at that area of the core compared to that voltage induced in undamaged areas of the core.

More important is flux (flux densities) $Ø_{NL}$, $Ø_{LL}$, produced by current flowing in wires, 20, 22, respectively, which are external to the core 6. For example, $Ø_{NL}$ travels for the most part through air surrounding neutral wire 20, and partially through a section of the toroidal core 6. When $Ø_{NL}$ enters the core 6, it sees a relatively high permeability path traveling around the core except at the magnetic anomaly 15. So, the flux will divide in the ratio of the permeability at that point, with the major portion of the flux taking the longer path. For $Ø_{LL}$ the reverse is true and this flux will take the shorter path because it has the highest permeability. Hence, there will be a detectably higher voltage induced in phase with the flux produced by the line current as opposed to the voltage in phase with the neutral current. This is in spite of the fact that the construction is perfectly symmetric and differential transformer core 6 is wound in an entirely uniform fashion.

The present invention attempts to remedy, or compensate for, such anomaly-induced voltage imbalances. In a case, as above-described with reference to FIG. 1, where the GFCI tripping sensitivity increases when load is applied, the differential transformer appears to find more current flowing through wire 18 to the load than returning on wire 16 resulting in spurious voltage difference detecting possibly erroneously sending the GFCI device into cutoff. To compensate, this invention reduces the amount of flux generated in the phase line by reducing the amount of current flowing through wire 18. This reduction is proportional to the load current. For example, a shunt wire can be connected around an outer portion of the core to wire 18 at points on opposite sides of the core 6 for shunting a portion of the current normally flowing in wire 18 through the core. It is the load current through the resistance of wire 18 that creates a voltage drop proportional to load current. In particular, the resistance of that segment of wire 18 that the two ends of the wire shunt are connected to.

A resistor connected in series with the shunt wire will define the voltage drop (and current flow) through the shunt, thereby adjusting the flux generated by the remainder of the current flowing through the core in wire 18. In a case where the current-difference sensitivity decreases, i.e., there is too little sensitivity, the shunt wire/resistor combination can be connected to points along wire 16, at either side of the core 6, such that less current flows through wire 16 rendering the field generated from the neutral wire less relative flux generated by the current flowing in the phase wire.

Figure 2A:
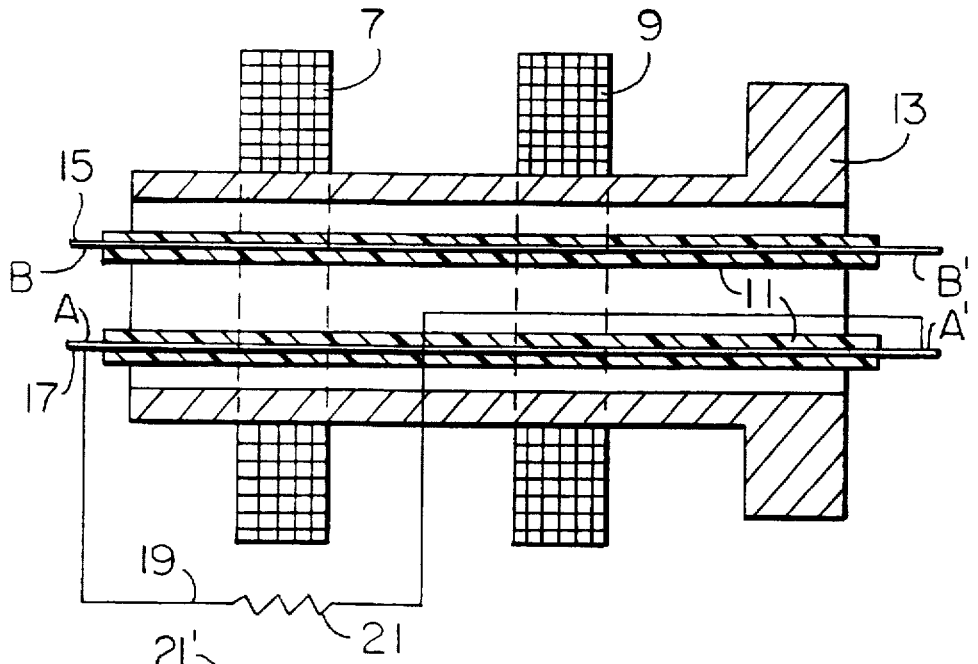
FIG. 2A is a schematic diagram of a differential transformer of the present invention which corrects detected current difference inaccuracies by compensation.

FIG. 2A shows a portion of a differential transformer including means for correcting for core defects which could result in erroneous current fault detection, the correction implemented through current compensation. In the figure, identifiers 7, 9 identify a first core (D.T.) and second core (N.T.), respectively, which are mounted upon a transformer bracket 13. Line wire 15, with insulation 11, is shown threaded through the cores' centers along with a neutral wire 17. A shunt path is included in the figure to adjust for undersensitive differential signal detection sensitivity. That is, wire 19 electrically shunts the portion of current flowing through wire 17 passing through DT core 7. Accordingly, a smaller current flows through core 7 than through core 9 in the return current path 17. A smaller flux is induced thereby in core 7. Wire 19 is electrically connected to wire 17 at points A and A', in series with a resistor 21. Assuming the distance from A to A' is around 1.5 inches, the wire's resistance is $5.02\times10^{\times4}$ ohms where the wire is 16 gauge wire. At 20 amps, the voltage drop through wire 19 is 0.001 volts. If the trip current at 20 amps is one milliamp, then $5.02\times10^{-4}\times20$ is approximately R×0.001, or, R equals 10 ohms to compensate for a 1 mA current. The result of the wire/resistor combination is a decrease in the field created by current returning from the load (not shown) in the neutral wire 17, thereby calibrating the current difference signal to substantially zero.

Figure 2B:
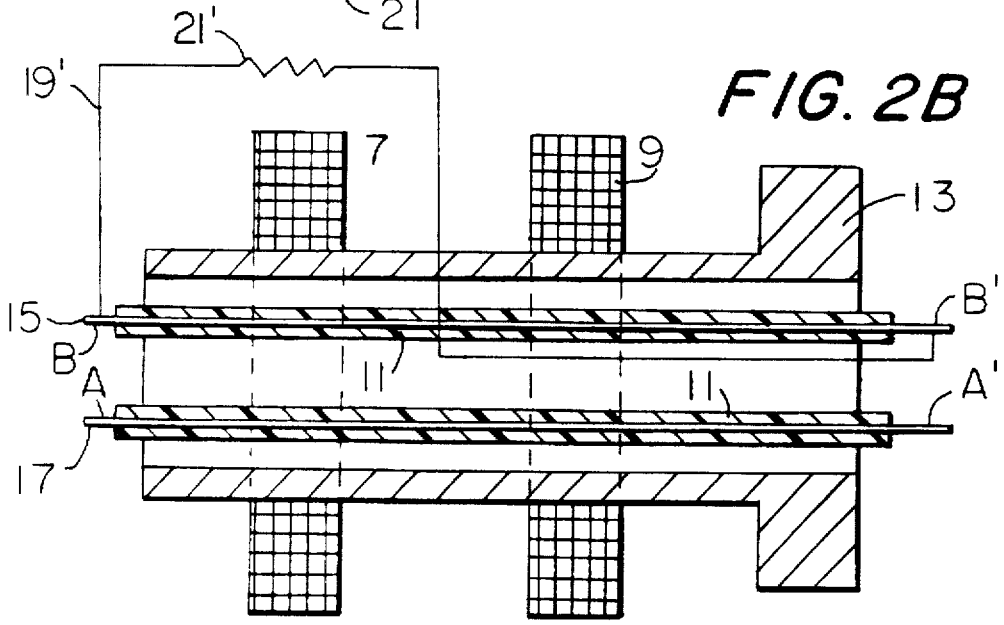
FIG. 2B is a schematic diagram of the differential transformer of FIG. 2A arranged to adjust for differing sensitivity.

FIG. 2B shows a portion of a differential transformer including means for correcting core defects by compensation in cases of oversensitivity. Oversensitivity is remedied by adding a length of wire extending outside of core 7 through core 9 and electrically connected as a shunt to wire 15 at connection points B and B' shown in the figure. A portion of current flowing through the core 7 is thereby shunted to reduce the field generated by the phase current therein.

The present invention also discloses a method for correcting signal differential detection sensitivity problems arising from non-uniformities in cores used to form differential transformers. A first step includes electrically connecting first and second shunt wires around the core(s) to each of a phase and neutral wire passing through the magnetic core. The shunt wires are connected to form a current path to shunt a portion of the current around rather than through the core where a case of under or oversensitivity is found to exist under no-fault condition. A resistor in series with each shunt wire's resistance defines a net impedance of the shunt wire/resistor combination. A next step includes testing the differential signal level to determine if there is a need to compensate for an imbalance resulting from core inconsistency. If compensation is required, the resistor (i.e., the shunt wire) attached to the wire in which the induced signal was found to be low is removed. Of course, the resistor/shunt wire combination may be added to shunt away current in the abnormally high signal wire after testing in lieu of the above method in accordance with the invention. A variation on this theme includes using multiple or variable resistors or resistor combinations to redefine core sensitivity levels.

Another method for adjusting sensitivity levels of a differential transformer comprising a magnetic core which displays magnetic anomalies includes building transformer assemblies with two extra wires for shunting away unwanted current to balance signals generated by currents flowing through the transformer. The first extra shunt wire is connected in shunt to the transformer wire which delivers current to the load, the second extra wire is shunt-connected to the transformer wire returning current from the load. These shunt wires may be terminated on pins, for example, with the wires forming the transformer windings. Another step includes determining the magnitude and direction of the detected current difference based on the fields generated in the through wires. Based on the determination, one of three types of transformer PC boards is chosen for use with the differential transformer to compensate for a detected over or under detection sensitivity. For example, if the detected current difference is within acceptable tolerance, then the PC board chosen does not connect either shunt wire. If the detected current difference is one of increased sensitivity, then the PC board connecting the shunt wire to the phase wire 15 (i.e., the wire delivering current to the load) to both ends of an appropriate resistor is used. Alternatively, if the detected current difference is one of decreased sensitivity, a PC board is used for shunting away a portion of the return current is used.

What has been described herein is merely descriptive of the preferred embodiment and is not meant to limit the scope of the invention, which can be applied in other embodiments, limited only by the following claims.

What is claimed is:

1. A differential transformer comprising a toroidal core formed of magnetic material which displays a non-uniform permeability resulting in a compromised differential signal detection ability including means for correcting said differential signal detection ability by compensation, said differential transformer further comprising:

a phase wire including a line end and a load end, said phase wire extending through a center of said magnetic core for transporting a first current in a first direction;

a neutral wire including a line end and a load end, said neutral wire extending through said magnetic core center for transporting a second current in a second direction, said second direction substantially opposite said first direction; and a shunt wire coupled in series with a single component comprising a resistor to further adjust an amount of said shunt current portion, said shunt wire having first and second ends, said shunt wire being electrically connected at its first and second ends to one of said phase and neutral wires to form a path for shunting a portion of one of said first and second currents outside said magnetic core ensuring that first and second signals generated in said transformer as a result of said currents are substantially adjusted.

2. The differential transformer defined by claim 1, wherein said phase wire electrically couples an AC source to a load and said neutral wire electrically couples said load to said AC source.

3. The differential transformer defined by claim 1, wherein when said second current is substantially equal to said first current a spurious voltage signal is generated indicative of an inequality between said first and second currents.

4. The differential transformer defined by claim 1, further including a second shunt wire, wherein said first and second shunt wires are electrically attached to shunt each of said phase and neutral wires and wherein a current difference signal generated by said core when said first and second currents are substantially equal is adjusted by electrically detaching one of said shunt wires.

5. A differential transformer with at least one toroidal core formed of a magnetic material in which erroneous signal differential detection occurring in said transformer pursuant to permeability inconsistencies within said core material are adjusted by compensation, said transformer comprising:

a first wire arranged to generate a first field in said core in proportion to a size and phase of a first signal propagating in said first wire;

a second wire arranged to generate a second field in said core in proportion to a size and phase of a second signal propagating in said second wire;

means for generating a difference signal in proportion to a difference between said first and second fields; and means including a third wire coupled in series with a single component comprising a resistor for adjusting a signal differential detection ability of said differential transformer if it is found that said difference signal indicates a field difference when said first and second fields are substantially equal.

6. A ground fault circuit interrupter including a differential transformer comprising a toroidal core through which a phase wire and a neutral wire for carrying current to and from a load are threaded, said differential transformer for detecting a difference in currents flowing within said phase and neutral wires and further comprising:

means for connecting a first shunt wire coupled in series with a single component comprising a resistor to said phase wire in such a way that a portion of current flowing therein is shunted around instead of through said toroidal core; and means for connecting a second shunt wire coupled in series with a single component comprising a resistor to said neutral wire in such a way that a portion of current flowing therein is shunted around instead of through said toroidal core, wherein one of said first and second shunt wires is electrically connected to compensate for an erroneous detection of unequal currents in said phase and neutral wires when said currents are substantially equivalent.

7. A method for compensating for erroneous difference signal detection within a differential transformer resulting from permeability inconsistencies present with a material forming a core of said transformer, comprising the steps of:

detecting a first current flowing in a first direction through said differential transformer core;

detecting a second current flowing in a second direction through said differential transformer core;

generating a difference signal in said core in proportion to a difference between said first and second currents;

determining whether said difference signal includes an error portion as a result of said permeability inconsistency; and compensating for said error portion by adjusting one of said first and second currents flowing through said transformer core.

8. The method defined by claim 7, wherein said step of compensating includes adding a path including a wire coupled in series with a single component comprising a resistor to shunt a portion of one of said first and second currents around said core.

9. The method defined by claim 7, wherein said step of compensating includes attaching first and second shunt wires to said phase and neutral wires, respectively, to create a first and second path for shunting current around said core.

10. The method defined by claim 9, wherein said step of compensating includes removing one of first and second shunt paths around said core to increase one of said first and second currents, respectively.

* * * * *